US005357772A

United States Patent [19]

Hendren

[11] Patent Number: 5,357,772

[45] Date of Patent: Oct. 25, 1994

[54] LAUNDRY MACHINE WITH COMBINATION DRUM DOOR/LOADING HOPPER

[75] Inventor: Charles W. Hendren, West Chester, Ohio

[73] Assignee: American Laundry Machinery, Ltd., Cincinnati, Ohio

[21] Appl. No.: 47,284

[22] Filed: Apr. 19, 1993

[51] Int. Cl.[5] ..... D06F 39/00

[52] U.S. Cl. ..... 68/210

[58] Field of Search ..... 68/210; 34/236; 414/13

[56] References Cited

U.S. PATENT DOCUMENTS

| | | | |
|---|---|---|---|
| 1,128,722 | 2/1915 | Renisch . | |
| 2,282,583 | 5/1942 | Henrici . | |
| 2,296,265 | 9/1942 | Russell . | |
| 2,330,605 | 9/1943 | Meyer . | |
| 3,177,592 | 4/1965 | Meyer . | |
| 3,417,582 | 12/1968 | Hertig et al. | 68/210 X |
| 3,505,836 | 4/1970 | Langston | 68/210 |
| 3,529,450 | 9/1970 | Pellerin | 68/210 X |
| 3,577,751 | 2/1971 | Hertig | 68/210 X |
| 3,677,039 | 7/1972 | Files | 68/210 X |
| 3,792,600 | 2/1974 | Hendriksson | 68/210 |
| 4,489,574 | 12/1984 | Spendel | 68/16 |
| 4,835,993 | 6/1989 | Dreher | 68/210 X |

FOREIGN PATENT DOCUMENTS

| | | | |
|---|---|---|---|
| 2126844 | 12/1972 | Fed. Rep. of Germany | 68/210 |

*Primary Examiner*—Philip R. Coe

*Attorney, Agent, or Firm*—Bacon & Thomas

[57] ABSTRACT

A laundry machine includes a drum having an opening through which launderable items may be delivered into and withdrawn from and a hopper unit that defines an internal passage between first and second open ends thereof. The hopper unit is pivotally attached to the laundry machine between an in-use position in which the second open end of the hopper unit is aligned with the drum opening for loading the machine and a non-use position in which the hopper unit is positioned remote from the drum opening to permit unloading of the drum. The hopper unit includes a closure member, mounted within the internal passage, that is movable between an open position wherein launderable items can freely pass through the internal passage and a closed position wherein the closure member closes the internal passage. With this arrangement, the hopper unit remains in its in-use position during both loading and laundering stages of operation of the machine and functions to reduce cycle time, increase machine capacity, improve safety and enhance machine efficiency.

13 Claims, 5 Drawing Sheets

LAUNDRY MACHINE WITH COMBINATION DRUM DOOR/LOADING HOPPER

BACKGROUND OF THE INVENTION

1. Field of the Invention

The present invention pertains to the art of laundry machines, such as washing, drying, dyeing machines or the like, and, more particularly, to a laundry machine including a loading hopper that incorporates a drum door.

2. Discussion of the Prior Art

Commercial/industrial machines used for laundering items are well known in the art. Such machines are often adapted to launder large amounts of items simultaneously and are therefore generally quite large. The steps of loading and unloading the launderable items from these machines are usually time consuming and, when performed manually, can present some awkward and hazardous conditions.

A conventional laundry machine is generally supported on a floor-mounted structural frame and is tilted relative to the horizontal into various operating positions. Such tilting is generally performed by hydraulic actuators but may be performed by other known actuator arrangements including pneumatic actuators and the like. The machine includes a tub or drum having an opening at a front end thereof through which the launderable items are delivered into and withdrawn from the drum. An access door is pivotally mounted on the front end of the machine to selectively open or close the drum opening.

During a loading stage, the machine is tilted such that the front end thereof is angled upwardly above horizontal and the access door is opened. At this point, the items to be laundered are manually placed into the drum through the opening and then the access door is closed. It is known that rotating the drum itself during this loading stage can significantly aid in loading the machine and that performing certain other internal operations, such as filling the drum with water at this stage, can minimize cycle time. However, these internal operations are often delayed until after the loading process is completed since they create a potential for worker injury. Following this loading stage of operation, the machine is tilted to a substantially horizontal position and the items are laundered therein. When his stage is complete, the machine is tilted such that the front of the drum is shifted downward so as to aid in the removal of the laundered items from the drum after the access door is again opened. Thereafter, the process is repeated.

As stated above, such prior art arrangements suffer from the drawbacks that the loading and unloading of the machines are difficult, time-consuming and potentially hazardous. In view of these drawbacks, it has also been heretobefore proposed in the prior art to aid in loading the drum by utilizing a hopper unit. Such a prior art arrangement is disclosed in U.S. Pat. No. 4,835,993 and includes a hopper unit that is pivotally attached to the machine about an axis located above the drum opening. During the loading stage, the access door of the machine is positioned remote from the drum opening and the hopper unit is positioned about the opening. Launderable items are then delivered into the drum through an open top of the hopper unit. Thereafter, the hopper is pivoted to a non-use position and the access door is closed so that the items may be laundered.

The prior art arrangement disclosed in the '993 patent evinces certain advantages over the other known prior art arrangements discussed above in that the drum of the machine can be rotated without subjecting a worker to injury during loading of the machine. In addition, since the launderable items are generally contained in large bags and delivery of the launderable items through the hopper unit is aided by gravity, substantially the entire loading operation of the machine can be performed without the worker directly contacting the launderable items. Instead, the worker merely has to open the various bags above the upper open end of the hopper unit. To further aid in loading the machine, the arrangement disclosed in the '993 patent provides for a supply of water to be delivered through the hopper unit.

Unfortunately, the prior art arrangement disclosed in the '993 patent does little to minimize cycle time. First, the machine must be positioned in its loading position and the access door must be removed before the hopper unit is pivoted to its in-use position. Then, following the loading operation, the hopper unit is placed in its non-use position and the access door is repositioned to seal the drum opening. These steps are time consuming and function to minimize cycle efficiency. In an attempt to minimize the cycle time, the drum in the '993 arrangement remains in a rearwardly and downwardly tilted position throughout both the loading and laundering stages of the machine. This is undesirable as a more efficient and thorough laundering operation can be performed with the drum in a substantially horizontal position. In addition, each and every mechanical movement of the access door and the hopper unit presents a potential for injury.

Therefore there exists a need in the art for a laundry machine that overcomes the problems and disadvantages associated with the prior art arrangements as discussed above. More specifically, there exists a need in the art for a laundry machine that reduces cycle time, improves safety, is cost effective and even has an increased operating capacity.

SUMMARY OF THE INVENTION

In accordance with the present invention, an improved laundry machine is provided wherein the operation thereof is significantly simplified while enhancing operator safety and the efficiency of the machine from cost, time and capacity standpoints.

The laundry machine of the present invention comprises a drum having an opening through which launderable items may be delivered into and withdrawn from and a hopper unit that defines an internal passage between first and second open ends thereof. In the preferred embodiment of the invention, the hopper unit is pivotally mounted to the laundry machine between an in-use position in which the second open end of the hopper unit is aligned with the drum opening for loading the machine and a non-use position in which the hopper unit is positioned remote from the drum opening to permit unloading of the drum. The hopper unit includes a closure member, mounted within the internal passage, that is movable between an open position wherein launderable items can freely pass through the internal passage and a closed position wherein the closure member closes the internal passage.

With this arrangement, the hopper unit remains in its in-use position during both loading and laundering stages of operation of the machine. During the loading stage, the closure member assumes its open position in order to readily permit launderable items to be delivered into the drum through the hopper unit and, during the laundering stage of operation, the closure member is closed to provide splash and/or vapor control. Furthermore, the portion of the internal passage between the closure member and the drum opening can further hold launderable items that can be drawn into the machine during operation thereof such that the capacity of the machine is increased.

If the laundry machine constitutes a washing machine or the like which requires the flow of liquid therein for its operation, a bank of spray nozzles are also provided within the hopper unit to assist in loading of the machine and also to supply the main or supplemental fluid required for operation. In accordance with the invention, the nozzles are located downstream of the closure member, i.e. between the closure member and the drum opening, wherein the closure member divides the internal passage into soiled goods and clean goods areas. The nozzles may also be used in conjunction with a pump for the circulation of fluid to enhance wash, supply mixing and/or agitation functions of the machine.

In addition, the laundry machine arrangement of the present invention is particularly adapted to be used in an automated laundering system such that the position and operational mode of the drum, hopper unit, closure member and spray nozzles are automatically controlled in a timed and systematic fashion. With this arrangement, a cost effective laundry machine having a minimum cycle time, with increased safety and operating capacity, is provided.

Additional details, features and advantages of the laundry machine of the present invention will become more readily apparent from the following detailed description of a preferred embodiment of the invention when taken in conjunction with the drawings wherein like reference numerals refer to corresponding parts in the several views.

DETAILED DESCRIPTION OF THE PREFERRED EMBODIMENT

Figure 1:
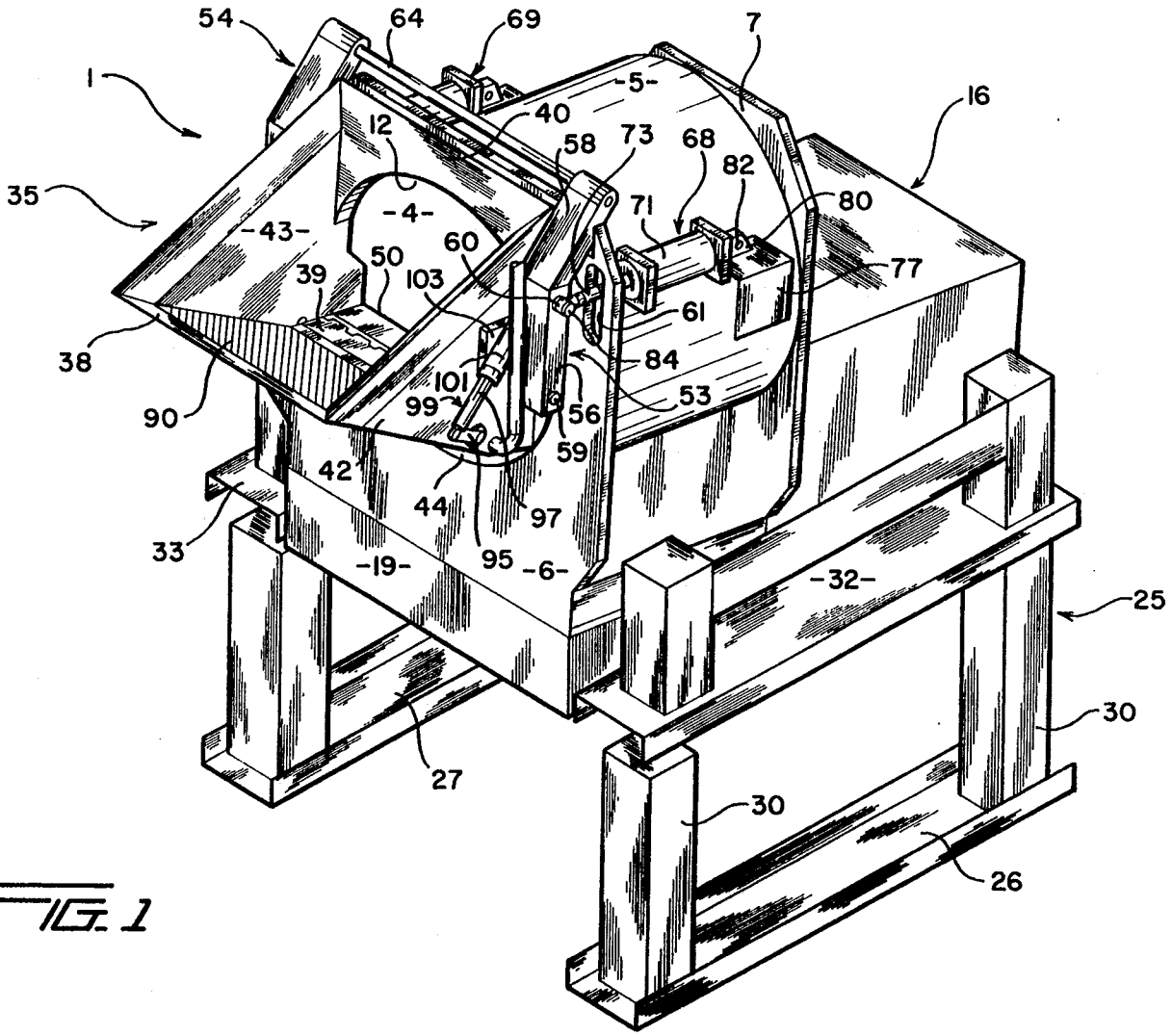
FIG. 1 depicts a perspective view of a laundry machine constructed in accordance with the present invention.
Figure 2:
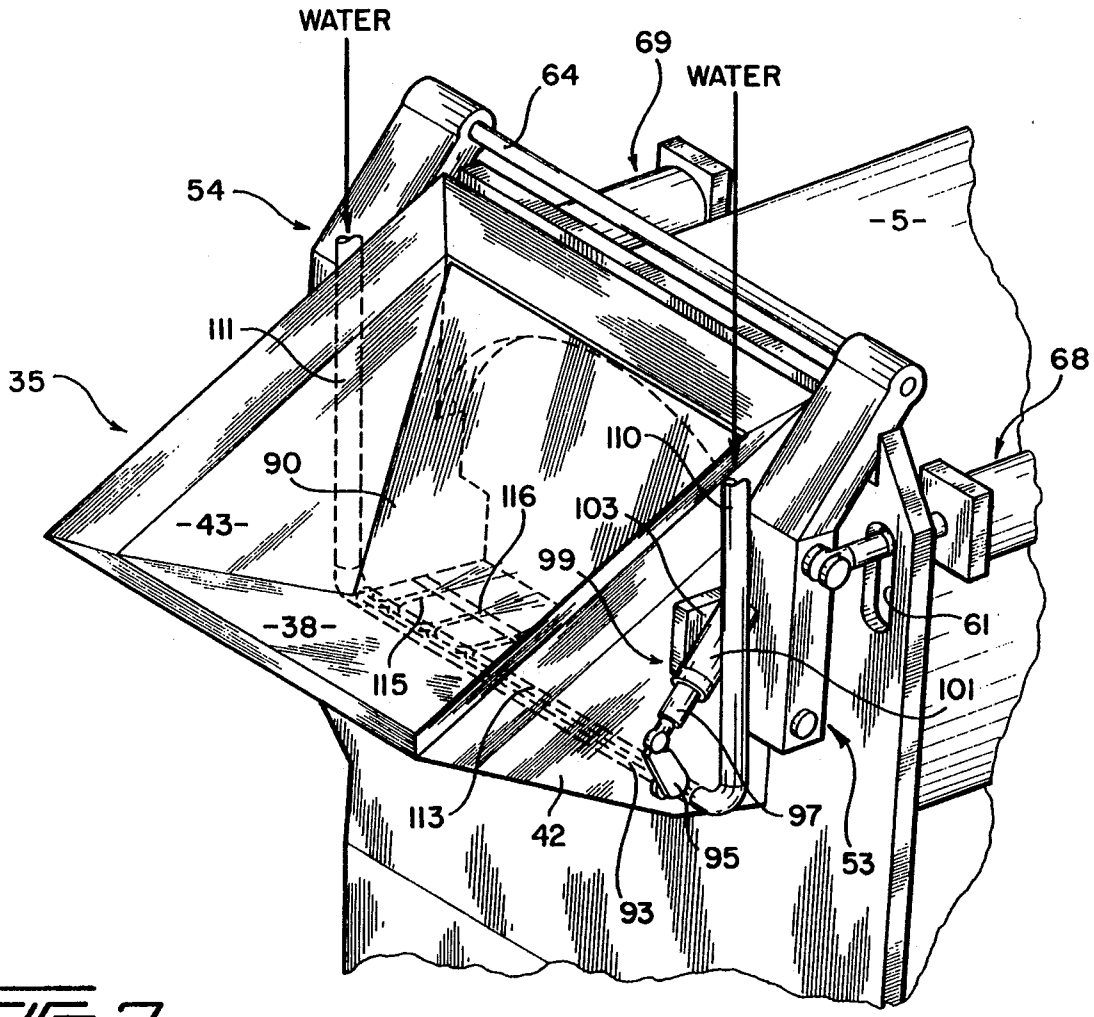
FIG. 2 shows an enlarged view of a portion of the laundry machine of FIG. 1 with the closure member re-positioned.

As illustrated in FIGS. 1 and 2, the laundry machine of the present invention is generally indicated at 1 and constitutes a machine for washing launderable items (not shown), such as linens and the like. Laundry machine 1 includes a drum 4 that is rotatably mounted within a cylindrical body 5 between a front plate 6 and a rear plate 7. Drum 4 is adapted to receive launderable items through an opening 12 provided in front plate 6.

Located behind rear plate 7 is a housing 16. Housing 16 is adapted to store various additional equipment necessary to operate laundry machine 1 in a manner widely known in the art. For instance, housing 16 can store a motor for rotating drum 4 by means of a shaft extending through rear plate 7 in a manner known in the art. Laundry machine 1 further includes a base 19 upon which cylindrical body 5 is mounted. Base 19 can be supported in numerous ways in accordance with the invention, such as through a support assembly generally indicated at 25. In the embodiment shown, support assembly 25 includes a pair of spaced mounting channels 26, 27 that are fixedly secured to a floor, various upstanding support legs 30 and a pair of cross braces 32, 33.

As is widely known in the art, drum 4, housing 16 and base 19 are adapted to be tilted relative to the horizontal and support assembly 25 between loading, laundering and unloading positions as will be more fully discussed below. As the particular structure for performing this tilting operation is conventional in the art, this structure has not been depicted in the drawings for clarity. In general, drum 4, housing 16 and base 19 are pivotally mounted to support assembly 25 so as to be rotatable about a substantially horizontal axis located below front plate 6 in response to raising and lowering of a rear portion of laundry machine 1 by means of a linear actuator or the like. Again, since the manner in which drum 4 is tilted is commonly known in the art and is not considered an inventive aspect of the present invention, it will not be further discussed herein in detail.

Figure 5:
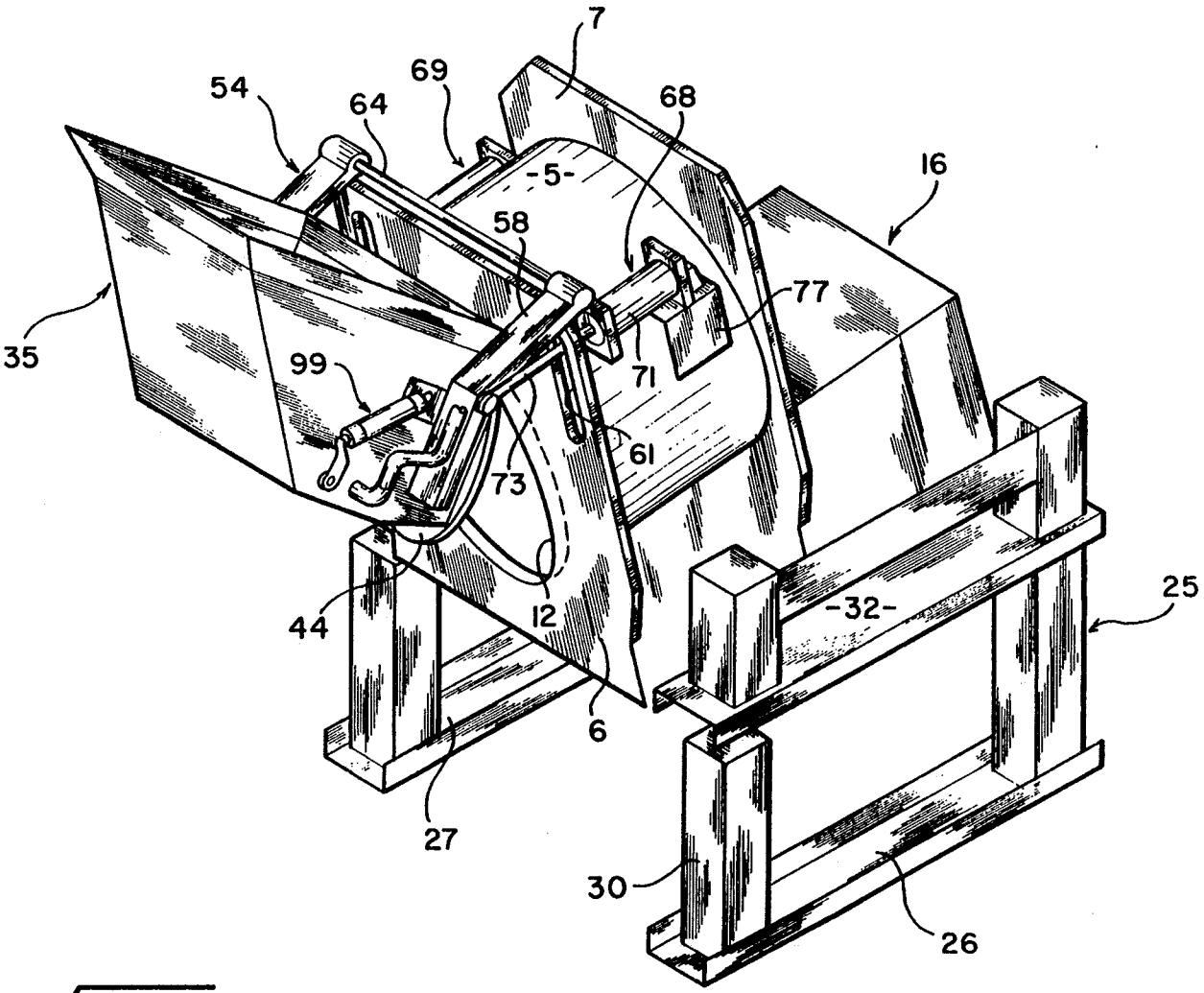
FIG. 5 depicts a portion of the laundry machine of FIG. 1 in an unloading stage of operation.

Laundry machine 1 further includes a hopper unit 35 which comprises a front wall 38, a base wall 39, a rear wall 40 and a pair of side walls 42, 43. In the preferred embodiment, front wall 38 is angled forwardly and upwardly with respect to base wall 39, rear wall 40 extends upwardly substantially perpendicular to base wall 39 and side walls 42, 43 are substantially perpendicular to each of the front, base and rear walls 38, 39, 40 respectively. As best shown in FIGS. 1 and 5, rear wall 40 includes a lower semi-circular plate portion 44. By this construction, hopper unit 35 defines an internal passage between an open first end 48 and an open second end 50. When in a first, in-use position as shown in FIG. 1, hopper unit 35 is positioned adjacent front plate 6 of laundry machine 1 such that the internal passage of hopper unit 35 is aligned with opening 12 with semi-circular plate portion 44 conforming to the shape of a lower portion of opening 12. In the preferred embodiment, a seal member (not shown) is carried by hopper unit 35 such that when hopper unit 35 is in its in-use position, rear wall 40 of hopper unit 35 is sealed against front plate 6.

A pair of mounting arms 53, 54, each having a substantially vertically extending first section 56 and an angled second section 58 are fixedly secured to side walls 42, 43 of hopper unit 35 by means of connectors 59, 60. Upper ends (not labeled) of second sections 58 are interconnected by a pivot rod 64. Pivot rod 64 defines a substantially horizontal axis about which hopper unit 35 can pivot relative to drum 4. In this regard, pivot rod 64 is adapted to extend through at least one journal bearing (not shown) which is fixedly attached to cylindrical body 5. Hopper unit 35 is adapted to pivot about pivot rod 64 between its first, in-use position shown in FIG. 1 and a second, non-use position wherein hopper unit 35 is located remote from opening 12 as shown in FIG. 5.

Front plate 6 of laundry machine 1 is formed with a pair of vertically extending slots 66 located on either side of hopper unit 35 (only one slot 66 being shown in the FIGURES). Laundry machine 1 further includes a pair of linear actuators 68, 69 each of which includes a cylinder 71 and an actuator rod 73. Each cylinder 71 is pivotally attached to a respective L-shaped plate 77 secured to cylindrical body 5. For this purpose, each L-shaped plate 77 carries a bifricated bracket 80 which receives an end portion (not labeled) of a respective cylinder 71 therebetween with a pivot pin 82 extending through each respective end portion and bifricated bracket 80, in addition, each actuator rod 73 is pivotally attached to a second section 58 of a respective mounting arm 53, 54 by means of a pivot pin 84. Linear actuators 68, 69 function in a manner commonly known in the art wherein fluid, either hydraulic or pneumatic, can be selectively delivered and withdrawn to individual chambers located on either side of a movable piston, which is attached to actuator rod 73 and housed within cylinder 71. Again, since the construction and operation of linear actuators 68, 69 are widely known in the art, they will not be further discussed in detail herein. By this construction, extension of linear actuators 68, 69 will function to pivot hopper unit 35 about pivot rod 64 to its non-use position shown in FIG. 5 and retraction of linear actuators 68, 69 will cause hopper unit 35 to assume the position shown in FIG. 1.

Figure 4:
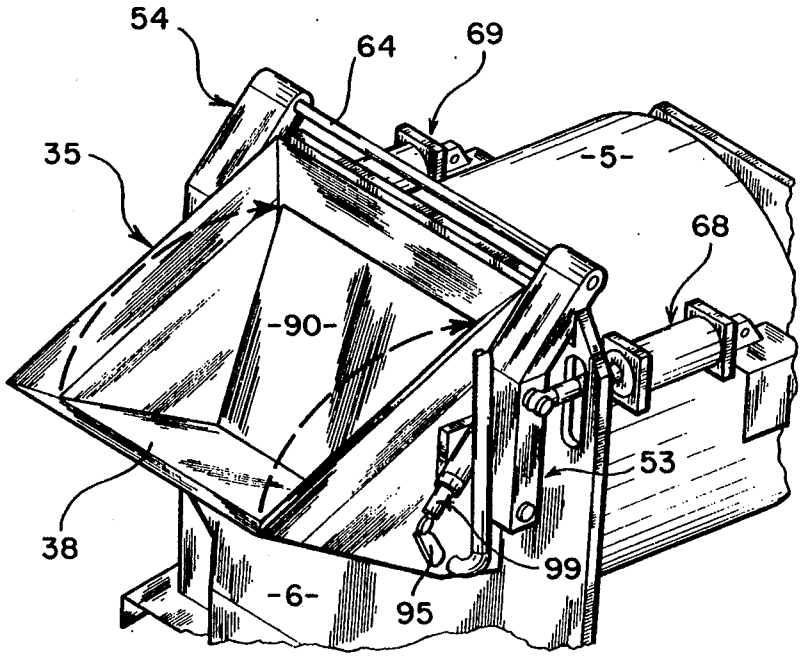
FIG. 4 depicts a portion of the laundry machine of FIG. 1 in a laundering stage of operation.

Hopper unit 35 further includes a closure member 90, one end of which is fixedly secured to a rod 93. Rod 93, in turn, is rotatably mounted to side wall 43 of hopper unit 35 and extends through a hole (not shown) in side wall 42. Outside of the internal passage defined by hopper unit 35, rod 93 is fixedly secured to one end of a lever 95. The other end of lever 95 is pivotally mounted to an actuator rod 97 of a linear actuator 99. Linear actuator 99 further includes a cylinder 101 that is attached to a plate 103 fixed to side wall 42. Again, it should be readily apparent to one of ordinary skill in the art that extension and retraction of linear actuator 99 will cause closure member 90 to be shifted between an open position as shown in FIG. 1 wherein closure member 90 overlies and extends substantially parallel to front wall 38 of hopper unit 35 and a closed position as best shown in FIGS. 2 and 4 wherein closure member 90 closes the internal passage of hopper unit 35. In the preferred embodiment, when closure member 90 is in its closed position, it seals drum 4 so as to provide splash and vapor control during the washing cycle of laundry machine 1 as will be more fully discussed below.

With particular reference to FIG. 2, laundry machine 1 includes a pair of inlet pipes 110, 111 for the introduction of fluids or processing chemicals into drum 4. Inlet pipes 110, 111 lead to a main conduit 113 that extends adjacent the juncture of front wall 38 and base wall 39, between closure member 90 and opening 12. Main conduit 113 has stemming therefrom a plurality of branch conduits 115 that terminate in spray nozzles 116. As will be more fully discussed below, nozzles 116 can aid in the loading of drum 4 with launderable items, can perform the function of filling or aid in the filling of drum 4 with water and, if used in conjunction with a pump, can perform circulating, mixing and/or agitating functions during a wash cycle.

Figure 3:
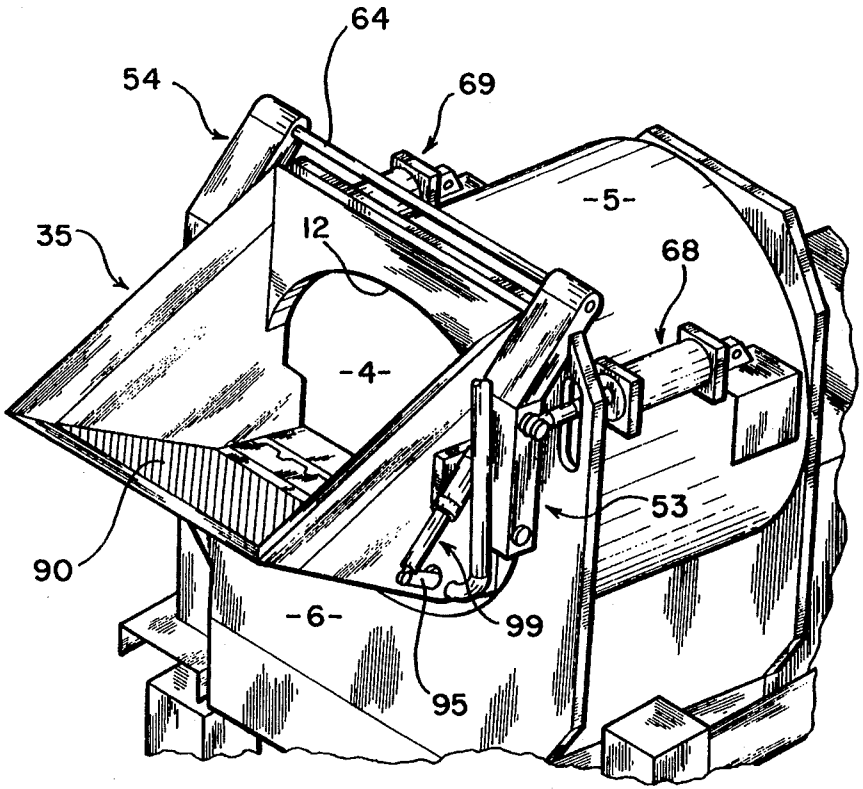
FIG. 3 depicts a portion of the laundry machine of FIG. 1 in a loading stage of operation.

The manner in which laundry machine 1 functions will now be described in detail with particular reference to FIGS. 3–5. Initially, drum 4 is tilted downwardly and rearwardly and hopper unit 35 is placed in its in-use position by means of linear actuators 68, 69 so as to assume a loading position as shown in FIG. 3. While in this position, launderable items may be emptied into open first end 48 of hopper unit 35 either manually or directly off a conveyor (not shown) or the like. Since closure member 90 is in its open position during this loading stage, the launderable items dropped into hopper unit 35 will pass into drum 4 through opening 12 by means of gravity. In addition, a fluid such as water can be delivered into inlet pipes 110, 111 and sprayed through nozzles 116 to aid in loading the launderable items.

Once a desired amount of launderable items are placed within hopper unit 35, closure member 90 is shifted to its closed position by retraction of linear actuator 99 as shown in FIG. 4. Since there may exist some launderable items still within hopper unit 35 as closure member 90 is closed, linear actuator 99 is adapted to shift closure member 90 in a pulsating manner so as to further push the launderable items into drum 4. Due to the position of closure member 90 and the manner in which it is closed, it should be evident that the capacity of drum 4 is increased. Either subsequent to or simultaneous with the closing of closure member 90, drum 4 is adapted to be tilted to a substantially horizontal, laundering position (FIG. 4). At this stage, the items are laundered within laundry machine 1.

After a predetermined laundry cycle time has elapsed, linear actuators 68, 69 are extended so as to cause pivoting of hopper unit 35 to its non-use position and drum 4 is tilted such that opening 12 is angled downwardly for unloading of laundry machine 1 as shown in FIG. 5. Following unloading of laundry machine 1, which can be performed either manually or automatically, laundry machine 1 is again positioned in the manner shown in FIGS. 1 and 3 and is ready for reloading. This completes one cycle of operation.

Figure 6:
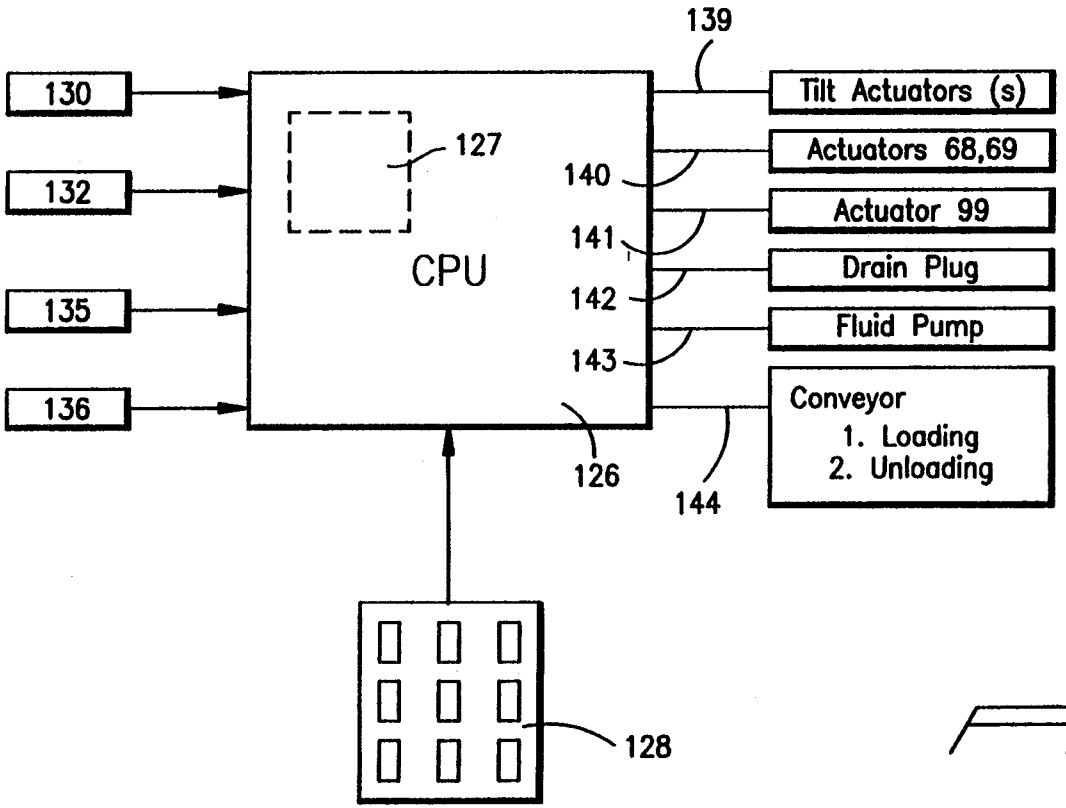
FIG. 6 is a schematic of an automatic control system for use in operating the laundry machine of the present invention.

Although the laundry machine described above readily lends itself to be used with manual loading and unloading thereof, in the preferred embodiment, the laundry cycle is substantially fully automated. In this regard, reference is made to FIG. 6 which schematically shows a control arrangement for systematically operating laundry machine 1. In FIG. 6 the control system is generally indicated at 125 and includes a CPU 126 having an internal timing circuit 127. The particular construction of CPU 126 and timing circuit 127 are not seen to be part of the present invention but rather are known in the art. CPU 126 is adapted to receive a plurality of electronic input signals and to control the operation of laundry machine 1 in response thereto in a pre-programmed manner as discussed below.

Initially, CPU 126 is responsive to signals received from a manual control pad 128 which can be used to manually select initial operating parameters for laundry machine 1 such as the type of items to be laundered, cycle times, etc. In addition, CPU 126 is adapted to receive signals from a pair of switches 130, 132 which provide an indication of the position of hopper unit 35, i.e., whether hopper unit 35 is in its non-use position (switch 130) or its in-use position (switch 132). In addition, CPU 126 receives signals from a scanner 135 adapted to be positioned adjacent opening 12 of drum 4 and from a water level sensor 136 for the reasons which will be outlined below. In response to these signals, CPU 126 is adapted to control the position of a drum tilting actuator (not shown) through a control line 139, the position of actuators 68, 69 through a control line 140, actuator 99 through a control line 1 41, the position of a drain plug (not shown) for drum 4 through line 142, the actuation of a fluid pump (not shown) through line 143 and/or the activation of loading and unloading conveyors (not shown) through control line 144.

With this automated control arrangement, when the hopper unit 35 is placed in its in-use position and, preferably, locked therein through the use of a latch or a solenoid valve which prevents the flow of fluid either into or out of linear actuators 68, 69, a signal will be received by CPU 126 from switch 132 and drum 4 will be placed in its loading position. At this point, the drain plug for drum 4 will be closed and water, or other processing fluids, will be caused to flow from spray nozzles 116 by activation of the fluid pump through control line 143. After a pre-programmed time delay, the laundry machine 1 will be assumed to be loaded and closure member 90 will be closed in the pulsating manner discussed above through control line 141. Once a pre-programmed water level is reached and signalled to CPU 126 by sensor 136, the laundering stage of operation begins. At the end of the laundering cycle and following draining of drum 4, hopper unit 35 will be automatically unlocked and drum 4 will be tilted to the position shown in FIG. 5. Once hopper unit 35 reaches its non-use position, switch 130 will provide a signal to CPU 126. At this point, as discussed above, unloading of drum 4 occurs. If unloading of drum 4 is also fully automated, signals from scanner 135 will be read by CPU 126 to indicate that no items have passed out of opening 12 for a predetermined time period, such as 5–10 seconds. This provides an indication to CPU 126 that the unloading process is finished. In response thereto, CPU 126 will cause laundry machine 1 to again assume a loading condition such that the laundering cycle can be repeated.

From the above detailed description of the invention, it should be readily apparent to one of ordinary skill in the art that a laundry machine constructed in accordance with the present invention will minimize cycle time, provide improved safety and increase the operating capacity of a sized unit according to the prior art. For instance, since hopper unit 35 remains in its in-use position during both loading and laundering stages of operation of laundry machine 1, the cycle time is reduced by the time needed to shift a hopper unit and/or an access door in accordance with the prior art. In addition, the cycle can start sooner because the proper washing level can substantially be achieved during the loading stage.

Although described with respect to a preferred embodiment of the invention, it should be readily understood that various changes and/or modifications may be made to the invention as described without departing from the spirit of the invention. For instance, although the invention was described with reference to a washing machine, it should be understood that the combination drum door/hopper arrangement of the present invention can be readily incorporated in various other types of laundry machines such as dryers, dyeing machines, and the like. In general, the invention is only intended to be limited by the scope of the following claims.

I claim:

1. A laundry machine comprising:

a drum having an opening through which launderable items may be delivered into and withdrawn from said drum;

a hopper unit defining an internal passage between first and second open ends thereof, said hopper unit being movably mounted with respect to said drum between in-use and non-use positions;

means for moving said hopper unit between said in-use position wherein the second open end of said hopper unit is aligned with said opening in said drum such that launderable items placed in the first open end of said hopper unit can pass through said internal passage and into said drum and said non-use position wherein the second open end of said hopper unit is located remote from said opening to permit removal of launderable items from within said drum; and a closure member pivotally attached to said hopper unit within said passage, said closure member being movable between an open position wherein launderable items can freely pass through said internal passage and a closed position wherein said closure member closes said internal passage.

2. A laundry machine as claimed in claim 1, further including means for pivoting said closure member between said open and closed positions.

3. A laundry machine as claimed in claim 2, wherein said hopper unit includes at least a rear wall defining said second open end, a front wall which is angled with respect to said rear wall and a pair of spaced side walls interconnecting said front and rear walls, said closure member overlying and extending substantially parallel to said front wall when in said open position and extending across said internal passage when in said closed position.

4. A laundry machine as claimed in claim 2, wherein said hopper unit is adapted to pivot relative to said drum about an axis located above the opening in said drum.

5. A laundry machine as claimed in claim 1, further including fluid spray means carried by said hopper unit, said fluid spray means including at least one fluid discharge nozzle located within said internal passage for assisting in loading launderable items into said drum through said internal passage when said hopper unit is in said in-use position.

6. A laundry machine as claimed in claim 5, wherein said at least one fluid discharge nozzle is located between said closure member and said second open end.

7. A laundry machine comprising;

a drum having an opening through which launderable items may be delivered into and withdrawn from said drum;

a hopper unit defining an internal passage between first and second open ends thereof, said hopper unit being movably mounted with respect to said drum between in-use and non-use positions;

means for moving said hopper unit between said in-use position wherein the second open end of said hopper unit is aligned with said opening in said drum such that launderable items placed in the first open end of said hopper unit can pass through said internal passage and into said drum and said non-use position wherein the second open end of said hopper unit is located remote from said opening to permit removal of launderable items from within said drum; and a closure member carried by said hopper unit, said closure member being movable between an open position wherein launderable items can freely pass through said internal passage and a closed position wherein said closure member closes said internal passages, wherein said laundry machine can undergo at least loading, laundering and unloading stages of operation wherein said drum is positioned at different angles with respect to a horizontal axis, said hopper unit being located in said in-use position during said loading and laundering stages and in said non-use position during said unloading stage, said closure member being located in said open position during said loading stage and in said closed position during said laundering stage.

8. A laundry machine as claimed in claim 7, wherein said closure member is pivotally attached to said hopper unit within said passage.

9. A laundry machine as claimed in claim 8, further including means for pivoting said closure member between said open and closed positions.

10. A laundry machine as claimed in claim 7, wherein said hopper unit includes at least a rear wall defining said second open end, a front wall which is angled with respect to said rear wall and a pair of spaced side walls interconnecting said front and rear walls, said closure member overlying and extending substantially parallel to said front wall when in said open position and extending across said internal passage when in said closed position.

11. A laundry machine as claimed in claim 7, wherein said hopper unit is adapted to pivot relative to said drum about an axis located above the opening in said drum.

12. A laundry machine as claimed in claim 7, further including fluid spray means carried by said hopper unit, said fluid spray means including at least one fluid discharge nozzle located within said internal passage for assisting in loading launderable items into said drum through said internal passage when said hopper unit is in said in-use position.

13. A laundry machine as claimed in claim 12, wherein said at least one fluid discharge nozzle is located between said closure member and said second open end.

* * * * *